US006966454B2

(12) United States Patent
Kawolics et al.

(10) Patent No.: US 6,966,454 B2
(45) Date of Patent: Nov. 22, 2005

(54) DISPENSER FOR CUP-SHAPED ARTICLES AND ADJUSTABLE RETAINER FOR SAME

(75) Inventors: Raymond P. Kawolics, Solon, OH (US); Henry G. Roethel, Ravenna, OH (US); Michael H. Meyer, Sagamore Hills, OH (US)

(73) Assignee: The Meyer Company, Cleveland, OH (US)

( * ) Notice: Subject to any disclaimer, the term of this patent is extended or adjusted under 35 U.S.C. 154(b) by 121 days.

(21) Appl. No.: 10/346,991

(22) Filed: Jan. 17, 2003

(65) Prior Publication Data

US 2003/0146240 A1 Aug. 7, 2003

Related U.S. Application Data

(60) Provisional application No. 60/349,792, filed on Jan. 17, 2002.

(51) Int. Cl.[7] ..... B65H 31/20
(52) U.S. Cl. ..... 221/241; 221/304
(58) Field of Search ..... 221/310, 304, 221/303, 308, 241, 297, 44, 45, 46, 307; 312/43, 71

(56) References Cited

U.S. PATENT DOCUMENTS

| | | | | |
|---|---|---|---|---|
| 1,131,255 A | * | 3/1915 | Luellen | 221/155 |
| 2,315,827 A | | 4/1943 | Tansley | |
| 3,211,329 A | * | 10/1965 | Boyd | 221/279 |
| 3,435,987 A | | 4/1969 | Saunders et al. | |
| 3,581,934 A | | 6/1971 | Sciascia | |
| 3,790,023 A | | 2/1974 | Filipowicz | |
| 4,079,858 A | | 3/1978 | Fuss | |
| 4,126,248 A | | 11/1978 | House | |
| 4,234,101 A | | 11/1980 | Pastore | |
| 4,261,480 A | | 4/1981 | Fuss | |
| 4,658,983 A | * | 4/1987 | Suttles | 221/44 |
| 4,854,479 A | * | 8/1989 | Callahan et al. | 221/304 |
| 4,881,660 A | | 11/1989 | Suttles | |
| 4,881,664 A | * | 11/1989 | Kawolics | 222/513 |
| 5,135,136 A | | 8/1992 | Moone | |
| 5,199,601 A | | 4/1993 | Roethel | |
| 5,201,869 A | | 4/1993 | Roethel | |
| 5,518,149 A | | 5/1996 | Lotspeich et al. | |

(Continued)

FOREIGN PATENT DOCUMENTS

GB 2 130 185 A 5/1984

*Primary Examiner*—Kenneth Noland
(74) *Attorney, Agent, or Firm*—Fay, Sharpe, Fagan, Minnich & McKee, LLP

(57) ABSTRACT

A dispenser for cup-shaped articles includes a housing defining a storage portion adapted to receive an associated stack of nested cup-shaped articles. The housing includes an open end that communicates with the storage portion. A cup retainer mounting base is located adjacent the open end of the housing. The mounting base defines an opening that communicates with the open end of the housing. The mounting base also defines a first plurality of mounting openings and a second plurality of mounting openings. A cup retainer is connected to the mounting base and restricts the opening of said mounting base. The cup retainer is movable between at least first and second operative positions wherein the cup retainer restricts the opening of the mounting base more in the first operative position as compared to the second operative position. The cup retainer is defined as separate stud members each including a resilient finger or as an annular band including a plurality of resilient fingers.

17 Claims, 7 Drawing Sheets

U.S. PATENT DOCUMENTS 5,709,316 A 1/1998 Jolly et al.
5,941,415 A * 8/1999 Roethel ..... 221/310
5,960,989 A 10/1999 Gunderson
6,325,243 B1 12/2001 Bennett

* cited by examiner

DISPENSER FOR CUP-SHAPED ARTICLES AND ADJUSTABLE RETAINER FOR SAME

CROSS-REFERENCE TO RELATED APPLICATION

This application claims benefit of the filing date of and priority from U.S. provisional application Ser. No. 60/349,792 filed Jan. 17, 2002.

BACKGROUND OF THE INVENTION

Cup dispensers are well known and come in a wide variety of configurations. U.S. Pat. Nos. 5,201,869 and 5,199,601 disclose cup dispensers that have enjoyed widespread commercial success, and both of these patents are hereby expressly incorporated by reference into this document.

Prior cup dispensers comprise an elongated hollow housing that holds a stack of nested cups. The cups are fed by gravity or are spring-biased toward an open end of the housing. A cup retainer such as a resilient diaphragm member spans the open end of the housing, and the closed end of the outermost cup (or other cup-shaped article such as an ice-cream cone, french fry container, etc.) projects outwardly through a central aperture defined in the diaphragm.

When a user desires to dispense a single cup, he or she pulls the closed end of the outermost cup so that the diaphragm distends and otherwise deforms to allow passage of the cup through the central aperture. The portion of the diaphragm that defines the periphery of the central aperture engages a rim at the open end of the next cup to be dispensed and prevents same from passing through the aperture.

To provide a cup dispenser that can accommodate and dispense more than a limited range of cup sizes/shapes, it has heretofore been necessary to install different diaphragms that have differently sized central apertures. This is somewhat inconvenient and increases expense in that multiple diaphragms must be manufactured and supplied. Furthermore, for optimal performance, the diaphragms are preferably manufactured from high-quality material that is relatively expensive. Thus, the diaphragm, itself, is a significant contributor to the final cost of the cup dispenser. Also, these prior diaphragms have been fixedly secured to the open end of the housing by means of a clamp ring that engages the periphery of the diaphragm and the open end of the housing with a friction fit. This clamp ring also adds to the expense of the cup dispenser and increases manufacturing complexity.

In light of the foregoing, it has been deemed desirable to develop and provide a new and improved dispenser for cup-shaped articles and an adjustable retainer for same.

SUMMARY OF THE INVENTION

In accordance with a first aspect of the present invention, a dispenser for cup-shaped articles comprises a housing defining a storage portion adapted to receive an associated stack of nested cup-shaped articles. The housing comprises an open end that communicates with the storage portion. A cup retainer mounting base is located adjacent the open end of the housing. The mounting base defines an opening that communicates with the open end of the housing. The mounting base also defines a first plurality of mounting openings and a second plurality of mounting openings. A cup retainer is connected to the mounting base and restricts said opening of said mounting base. The cup retainer is movable between at least first and second operative positions wherein the cup retainer restricts the opening of the mounting base more in the first operative position as compared to the second operative position.

In accordance with another aspect of the present invention, a retainer for cup-shaped articles comprises a resilient annular member and a plurality of fingers connected to and projecting radially inwardly from the annular member. The fingers define therebetween a space for passage of cup-shaped articles. The annular member is selectively radially expandable to increase a distance between the fingers to accommodate larger sized cup-shaped articles in the space.

In accordance with another aspect of the present invention, a dispenser for cup-shaped articles comprises a body comprising an open end. A plurality of resilient fingers are connected to the body adjacent the open end. At least some of the fingers are selectively movable between different operative positions to adjust spacing between the fingers.

BRIEF DESCRIPTION OF THE DRAWINGS

The invention comprises various components and arrangements of components, preferred embodiments of which are illustrated in the accompanying drawings that form a part hereof and wherein.

DETAILED DESCRIPTION OF PREFERRED EMBODIMENTS

Figure 1:
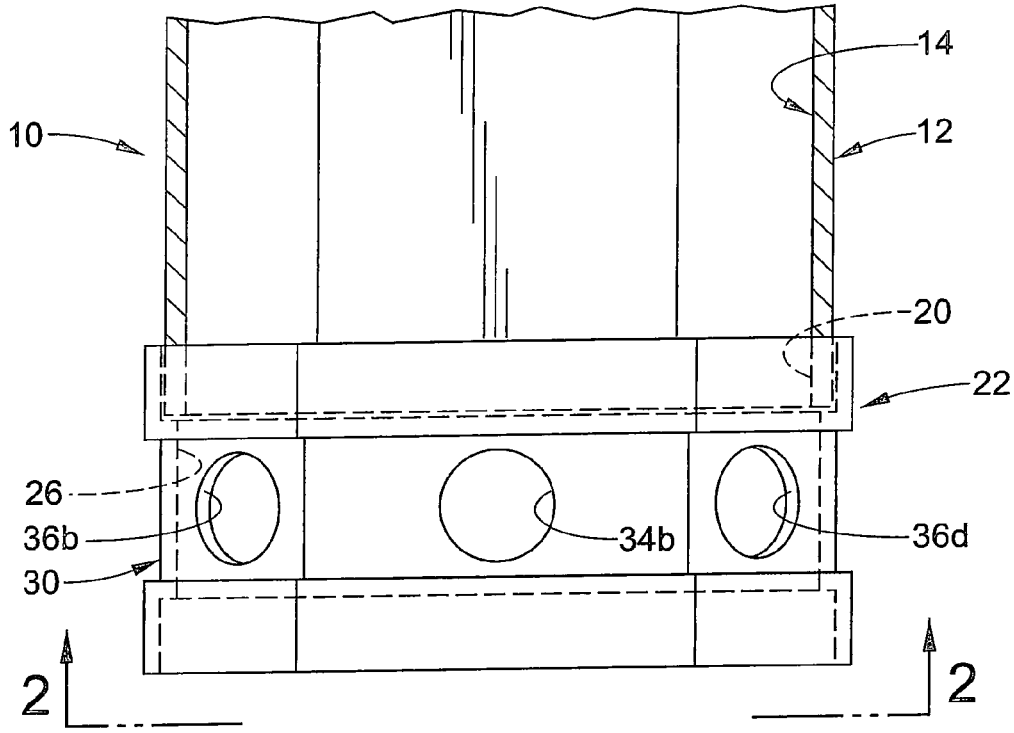
FIG. 1 is a partial side elevational view of a cup dispenser housing formed in accordance with the present invention, with a portion of the housing shown in section.

Referring now in detail to FIGS. 1–5B of the drawings briefly described above, a cup dispenser housing 10 formed in accordance with the present invention comprises a elongated cup storage portion 12 that includes or defines a bore or other internal space 14 adapted to receive a stack of nested cups or cup-shaped articles such as drinking cups, french-fry cups, ice-cream cones, lids, etc., having a closed or restricted first end and an open second end. The cup storage portion 12 includes or defines an open end 20 that communicates with the internal cup storage space 14 and through which the cups or other cup-shaped articles are dispensed from (and inserted into) the storage space 14.

The cup dispenser housing 10 further comprises a cup retainer mounting base 22 that is connected to or defined as an integral or one-piece part of the open end 20 of the cup storage portion 12. The cup retainer mounting base 22 is preferably generally ring-shaped or annular and defines an internal opening or aperture 26 that communicates with the cup storage space 14. Associated cups or other cup-shaped articles are dispensed from the cup storage space 14 through the open end 20 of the cup storage portion 14 and then through the internal opening 26 of the cup retainer mounting base 22. Retainer mounting base 22 need not be completely annular and can alternatively be defined by a plurality of circumferentially spaced-apart base portions separated by gaps or spaces.

Figure 2:
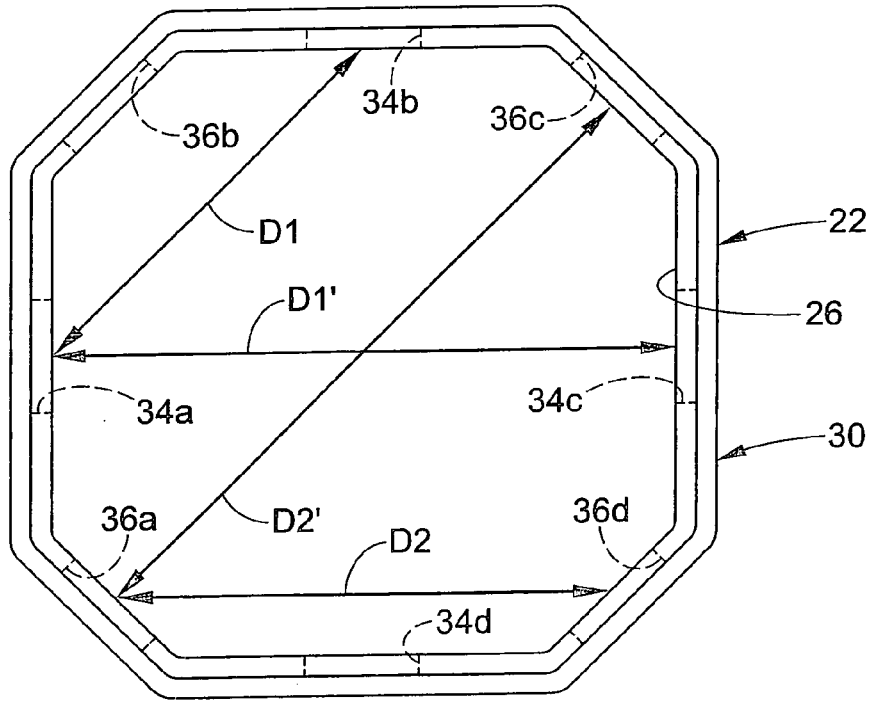
FIG. 2 is a view taken along line 2—2 of FIG. 1.

The cup retainer mounting base 22 includes an outer surface 30, and a plurality of retainer mounting locations or openings such as the illustrated radial apertures 34*a*–34*d*, 36*a*–36*d* that are defined through the outer surface 30 and communicate with the internal opening 26. As an alternative to the apertures 34*a*–34*d*,36*a*–36*d* the mounting locations can be defined by slots or other openings in the mounting base 22. As shown in FIG. 2, the outer surface 30 is conformed and dimensioned so that a first plurality of the apertures 34*a*,34*b*,34*c*,34*d* define a first set and so that a second plurality of apertures 36*a*,36*b*,36*c*,36*d* define a second set. Consecutive or successive apertures 34*a*–34*d* of the first set are spaced from each other by a straight-line distance D1 (as measured center-to-center or otherwise) that is less than a corresponding distance D2 between consecutive or successive apertures 36*a*–36*d* of the second set. In the illustrated embodiment, the apertures 34*a*–34*d* of the first set are arranged in opposed pairs separated by a distance D1', while the apertures 36*a*–36*d* of the second set are arranged in opposed pairs separated by a corresponding distance D2'. Here, again, the distance D1' is less than the corresponding distance D2'.

The cup dispenser housing 10, including the cup storage portion 12 and the cup retainer mounting base 22, can be defined from any suitable material(s) as a one-piece construction or an assembly of separate components joined by any suitable means. Further, the cup storage portion 12 and the cup retainer mounting base 22 can be defined from the same or different materials. Suitable materials include molded plastic materials or metals or metal alloys such as stainless steel or aluminum. Furthermore, in one embodiment, the cup storage portion 12 is releasably secured to the cup retainer mounting base 22 and selectively separable therefrom to facilitate insertion of a stack of nested cups or cup-like articles into the cup storage space 14.

Figure 3:
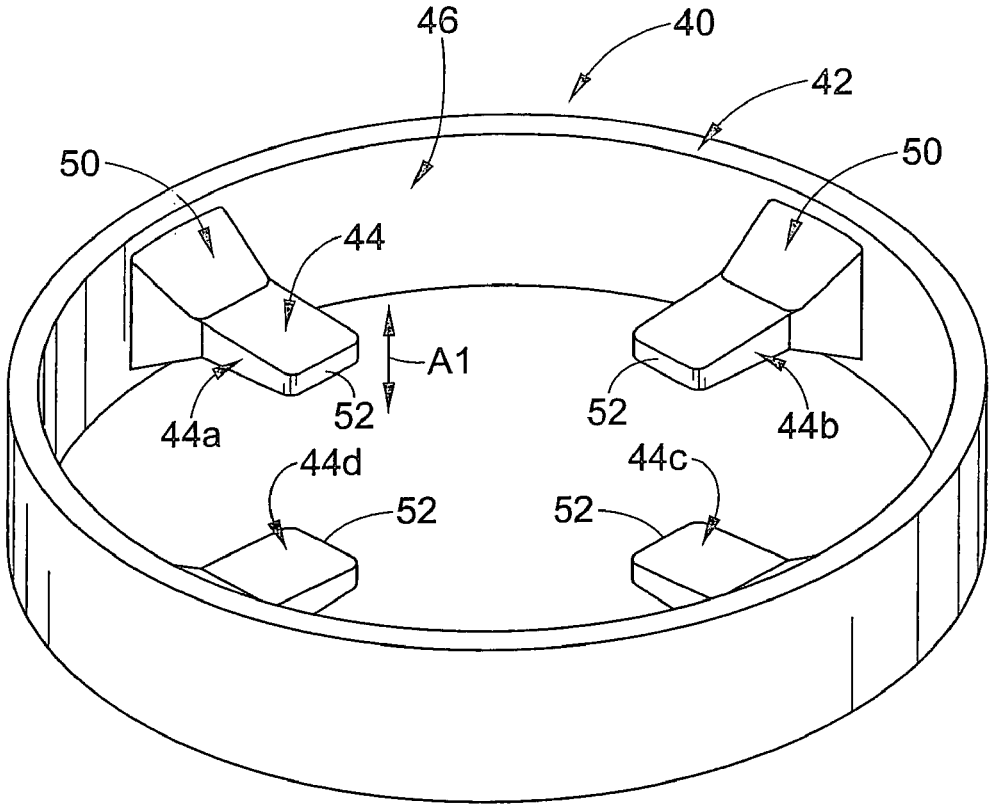
FIG. 3 is an isometric view of a cup retainer formed in accordance with the present invention.

A cup retainer is used to control the passage of cups or other cup-like or cup-shaped articles out of the cup storage space 14 through the opening 26 of the cup retainer mounting base 22, i.e., the cup retainer restricts the opening 26. With reference to FIG. 3, a first embodiment of a cup retainer 40 comprises a resilient annular band member 42 that includes or defines a plurality of resilient cup-retention fingers or projections 44 that extend or project radially inwardly from an inner surface 46 the band member 42. Preferably, at least three cup-retention fingers 44 are provided and, as illustrated, it is most preferred that at least four cup-retention fingers 44 be provided as shown at 44*a*,44*b*, 44*c*,44*d*. More generally, it is most preferred that the number of fingers 44 be equal to the number of apertures defining the first set of apertures 34*a*–34*d* and the second set of apertures 36*a*–36*d*.

The fingers 44 of the cup retainer 40 each comprise a base portion 50 adjacent the inner surface 46 of the band 42 and a distal tip or end 52 spaced from the inner surface 46. The base portion 50 is enlarged relative to the distal end 52. The fingers 44 are bi-directionally flexible as indicated by the arrow A1. The cup retainer 40 is preferably defined from a resilient material such as rubber or any elastomer or thermoplastic. It is preferred that the cup retainer 40 be injection molded or otherwise molded as a one-piece construction, although this is not absolutely required.

Figure 4A:
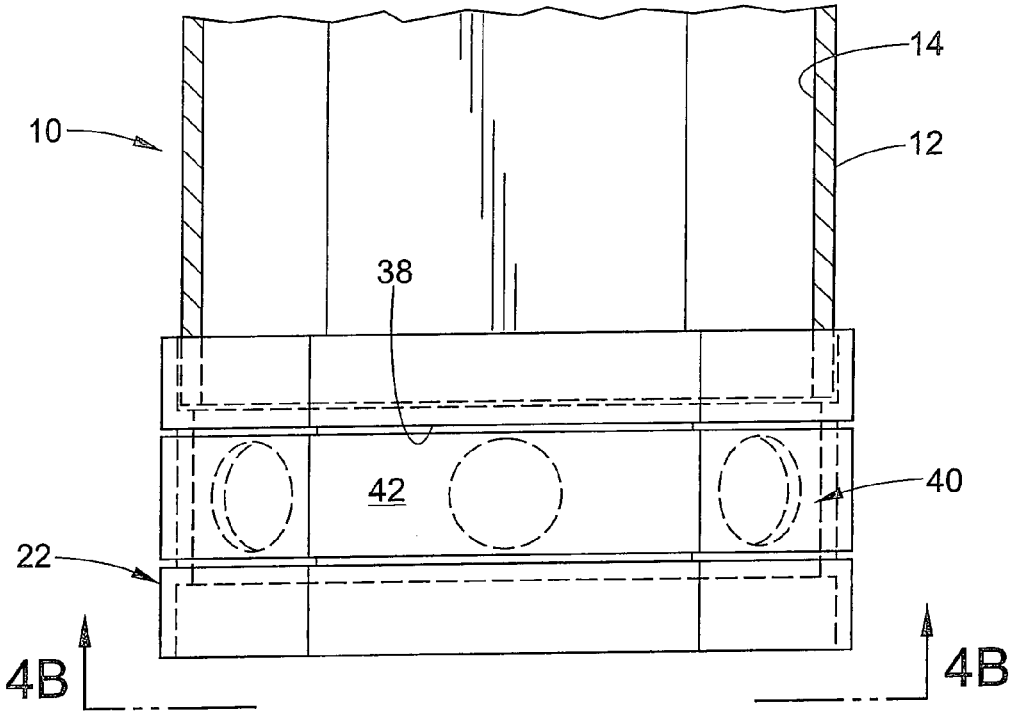
FIG. 4A illustrates the cup dispenser housing of FIG. 1 with the cup retainer of FIG. 3 installed in a first operative position.
Figure 4B:
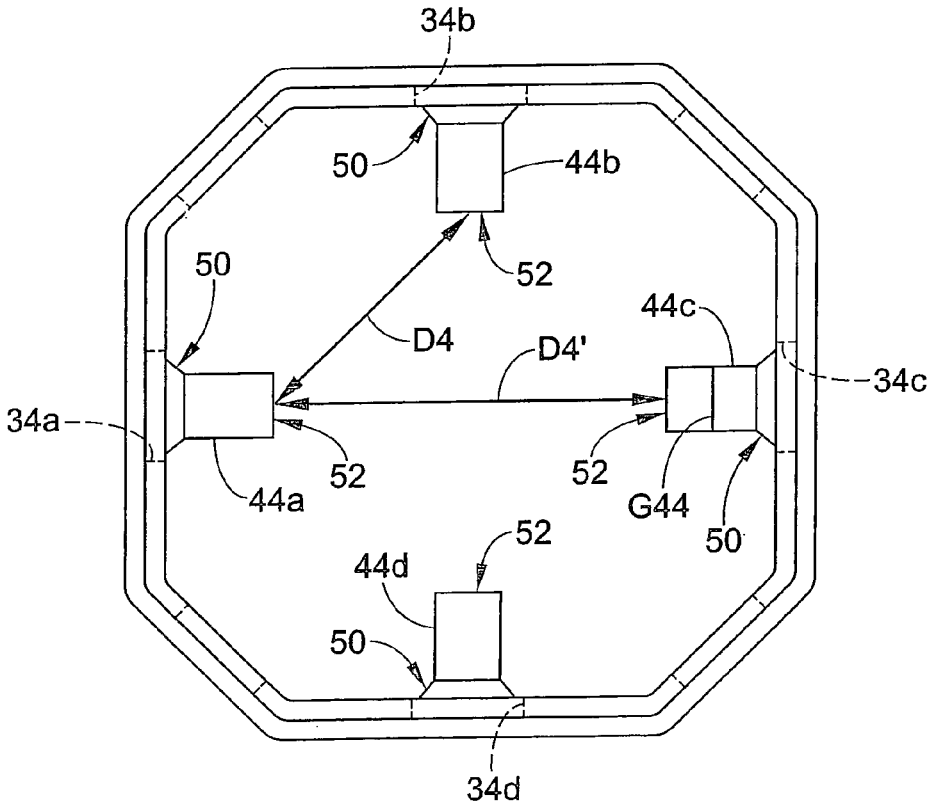
FIG. 4B is a view taken along line 4B—4B of FIG. 4A.

FIGS. 4A and 4B illustrate the cup retainer 40 as installed on the mounting base 22 of the cup dispenser housing 10 in a first operative position. In particular, the band 42 closely and tightly circumscribes the cup retainer mounting base 22, and the fingers 44*a*–44*d* project respectively through the first set of radial apertures 34*a*–34*d* and into the opening 26 of the retainer mounting base 22. The outer surface 30 of the cup retainer ring preferably includes or defines a groove 38 that receives the band 42.

Figure 5A:
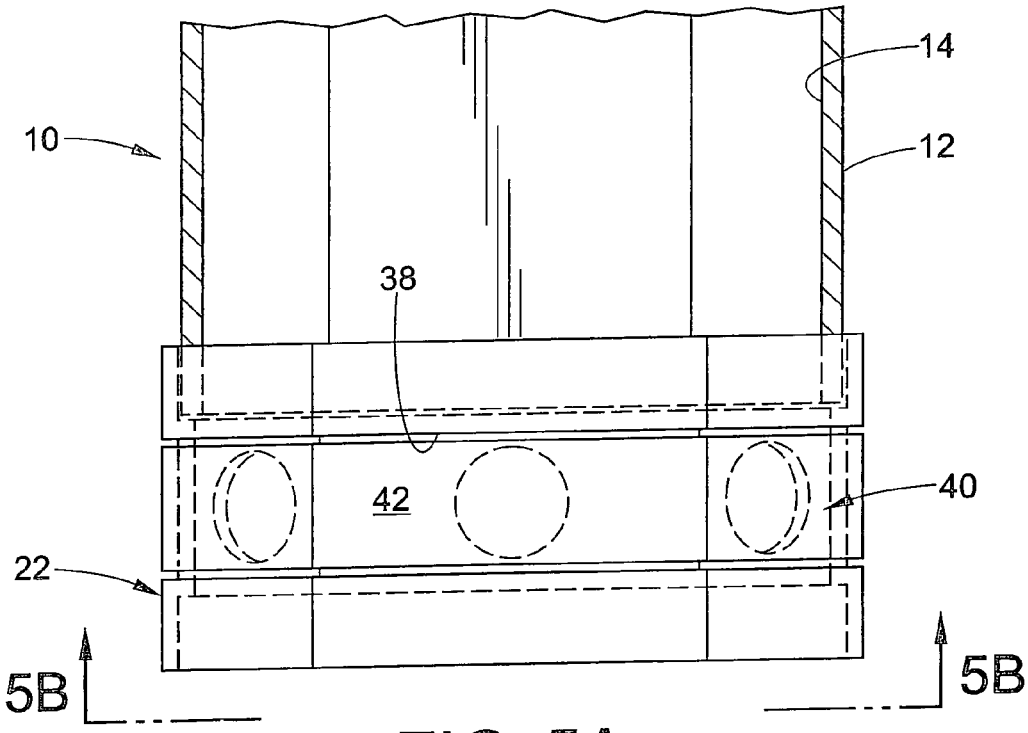
FIG. 5A illustrates the cup dispenser housing of FIG. 1 with the cup retainer of FIG. 3 installed in a second operative position.
Figure 5B:
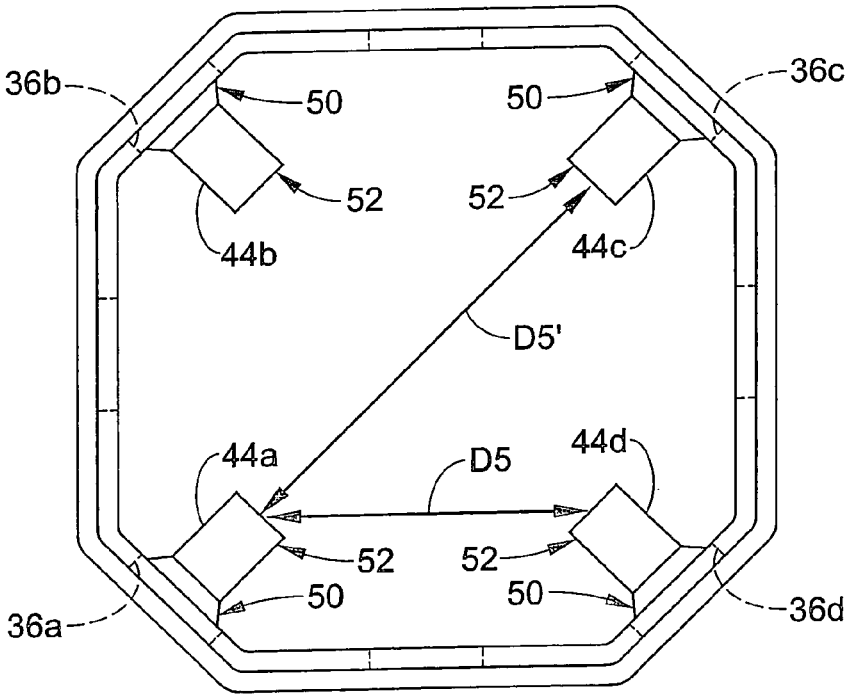
FIG. 5B is a view taken along line 5B—5B of FIG. 5A.
Figure 6A:
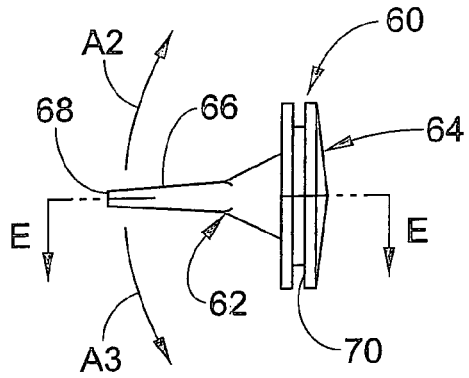
FIGS. 6A, 6B and 6C illustrate a cup retainer formed in accordance with a second embodiment of the present invention.
Figure 6B:
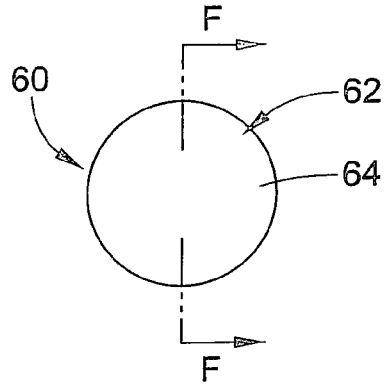
Figure 6C:
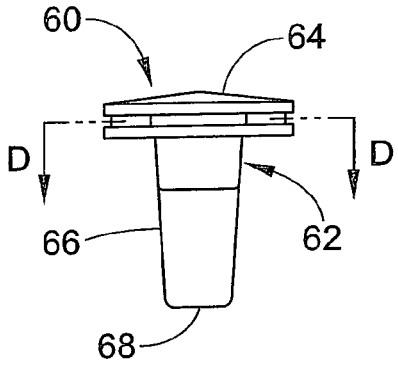
Figure 6D:
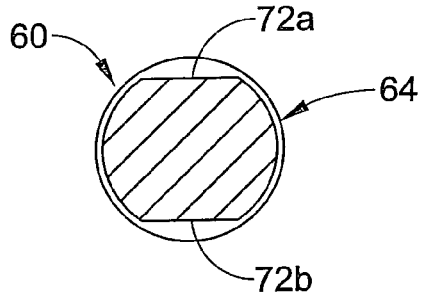
FIG. 6D is a sectional view taken along line D—D of FIG. 6C.
Figure 6E:
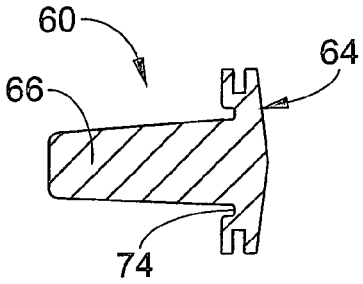
FIG. 6E is a sectional view taken along line E—E of FIG. 6A.
Figure 6F:
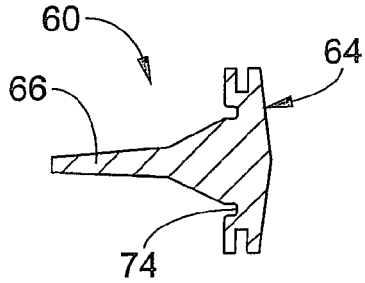
FIG. 6F is a sectional view taken along line F—F of FIG. 6B.

Similarly, FIGS. 5A and 5B illustrate the cup retainer 40 as installed on the cup dispenser housing 10 in a second operative position. In the second operative position, the band 42 closely and tightly circumscribes the cup retainer mounting base 22, and the fingers 44*a*–44*d* project respectively through the second set of radial apertures 36*a*–36*d* and into the opening 26 of the ring 22. Here, again, the band 42 is located in the groove 38.

Comparing FIGS. 4B and 5B, it can be seen that the fingers 44*a*–44*d* are spaced closer together when the cup retainer 40 is installed in the first operative position (FIG. 4B) as compared to when it is installed in the second operative position (FIG. 5B). More particularly, when the cup retainer 40 is installed in its first operative position (FIG. 4B), a distance D4 (measured between the centers of their outermost tips 52 or otherwise) is defined between consecutive or successive fingers 44 or, if the fingers 44 are directly opposed as illustrated herein, a distance D4' is defined between opposed fingers 44. When the cup retainer 40 is installed in its second operative position (FIG. 5B), a distance D5 (measured between the centers of their outermost tips 52 or otherwise) is defined between consecutive or successive fingers 44 or, if the fingers 44 are directly opposed as illustrated herein, a distance D5' is defined between opposed fingers 44.

Regardless of the measuring method used, the distance D4,D4' defined between the fingers 44*a*–44*d* when the cup retainer 40 is located in the first operative position is less than a corresponding distance D5,D5' defined between the fingers 44*a*–44*d* when the cup retainer is located in the second operative position. Thus, those of ordinary skill in the art will recognize that the cup dispenser is adapted to dispense a first cup size or range of cup sizes when the cup retainer 40 is located in the first operative position, and the cup dispenser is adapted to dispense a second, larger cup size or range of cup sizes when the cup retainer is located in its second operative position.

Those of ordinary skill in the art will recognize that a cup retainer mounting base 22 formed in accordance with the present invention can have any desired shape, as long as it is conformed to alter the spacing between the fingers 44 of the cup retainer 40 when the cup retainer 40 is located in different operative positions. Also, while two different sets of radial apertures 34*a*–34*d*, 36*a*–36*d* are used in the illustrated embodiment to define two different operative positions for the cup retainer 40, more than two sets of radial apertures can be used to define more than two different operative positions. Furthermore, in either of the first or second operative positions, the cup retainer 40 is self-adjusting in that the band 42 can expand radially to accommodate larger cups. As cup diameter increases, the band 42 expands radially so that the fingers 44 do not become deformed and/or pinched between the cups being dispensed and the mounting base 22. This resilient expansion and contraction of the band 42 helps the fingers 44 control cup movement because the action of the fingers 44 is combined with the radial expansion/retraction of the band 42 to control cup movement. The ability of the band 42 to expand radially also facilitates insertion of a stack of cups into the dispenser housing 10 through the cup retainer mounting base 22 and the open mouth 20 of the cup storage portion 12 because expansion of the band 42 moves the fingers 44 radially outwardly.

The fingers 44 of the cup retainer 40 can optionally be conformed to flex more easily in a first direction than in a second direction. In one such alternative embodiment, the fingers 44 are designed to flex more easily moving inwardly toward the cup storage space 14 so that a stack of nested cups can be more easily inserted into the cup storage space 14 to reload the cup dispenser. This non-symmetrical flexibility can be accomplished in a wide variety of ways. In one embodiment as shown in FIG. 4B, an optional slit or groove G44 is defined in an outer or bottom surface at least some or all of the fingers 44 (only one groove G44 is shown) The groove G44 extends partially through the thickness of the finger 44 so as to define a weakened or thin hinge region in each finger 44 that facilitates flexing of the finger 44 in one direction at the location of the groove G44. The groove G44 is preferably defined during a molding operation during manufacture of the retainer 40, but can be formed after in a separate process.

FIGS. 6A–6F illustrate a cup retainer formed in accordance with a second embodiment of the present invention. The cup retainer comprises a plurality of retainer studs 60 each comprising a stud member 62 that includes a base 64 and a cup-retention finger 66 that projects outwardly away from the base 64 to a distal end 68. The base 64 is conformed and dimensioned to be received by and retained in one of the radial apertures 34*a*–34*d*, 36*a*–36*d* of the cup retaining ring 22, with the finger 66 extending through the aperture and into the interior opening 26 of the cup retaining ring 22. More particularly, the base 64 includes a circumferential groove 70 or other portion that is adapted to receive and engage the portion of the cup retainer mounting base 22 that defines the periphery of the apertures 34*a*–34*d*, 36*a*–36*d* so that the cup retainer stud 60 is firmly held in the aperture as shown in FIGS. 7A, 7B, 8A, 8B. Furthermore, the base 64 also includes flats 72*a*,72*b* or is otherwise conformed so that it is non-rotatably received in one of the apertures 34*a*–34*d*, 36*a*–36*d*. This ensures that the finger 66 is held in the required orientation so that the wider face thereof engages the associated cups. A groove 74 is defined in the base 64 adjacent the innermost end of the finger 66. The groove 74 helps to bias the finger 66 outwardly away from the base 64 and into the opening 26 of the cup retaining ring 22.

The cup retainer stud 60 is preferably defined from a resilient material such as rubber or any elastomer or thermoplastic. It is preferred that the cup retainer stud 60 be injection molded or otherwise molded as a one-piece construction.

Figure 7A:
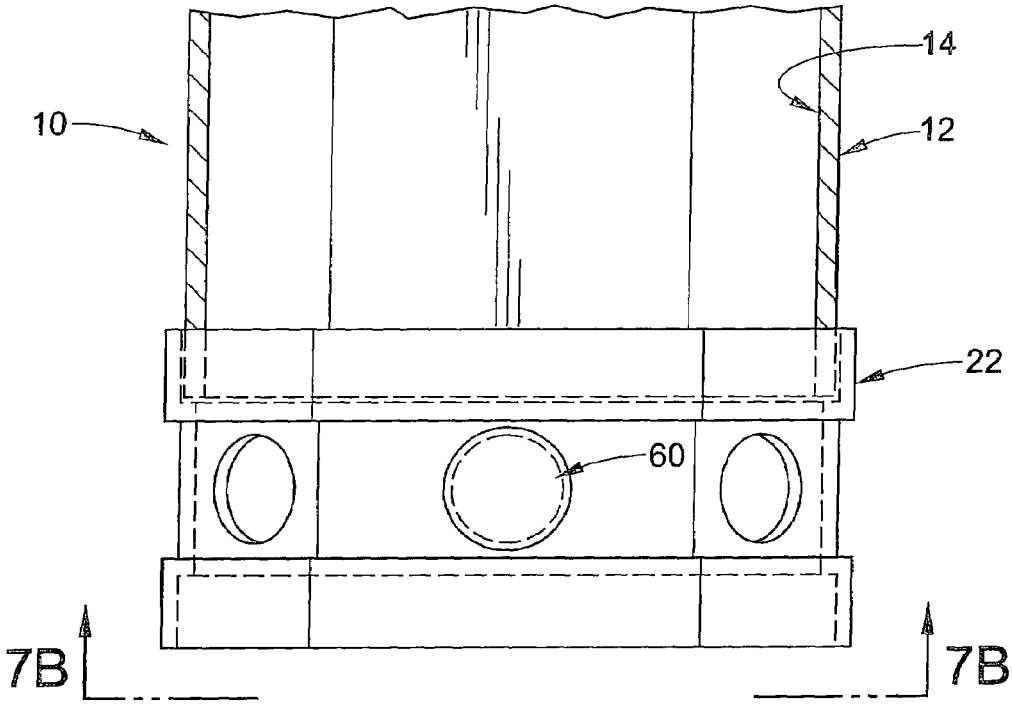
FIG. 7A is illustrates the cup dispenser housing of FIG. 1 with the cup retainers illustrated in FIGS. 6A–6C connected thereto in a first operative arrangement.
Figure 7B:
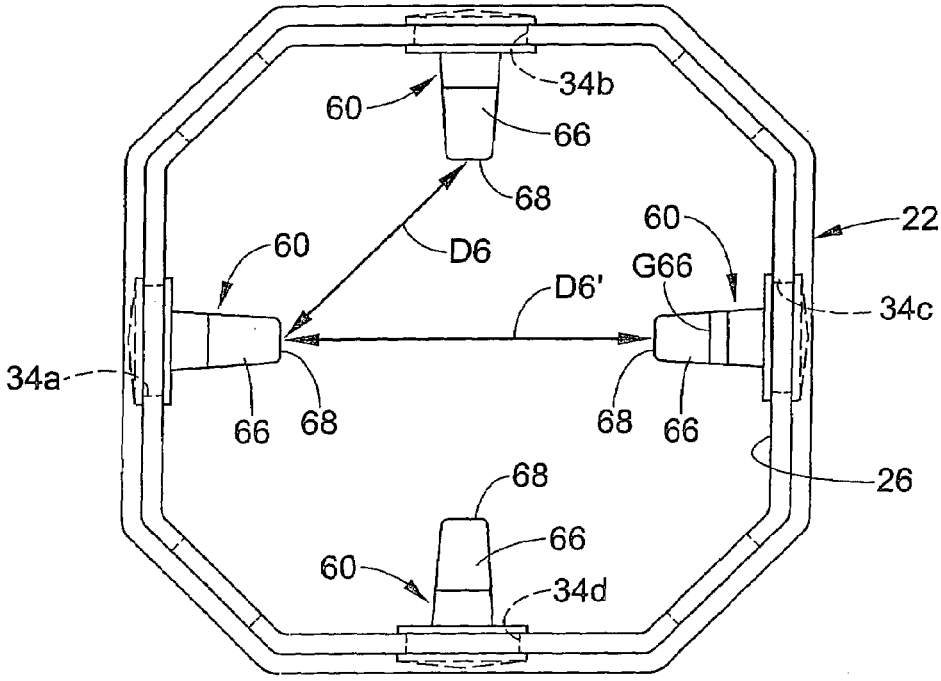
FIG. 7B is a view taken along line 7B—7B of FIG. 7A.
Figure 8A:
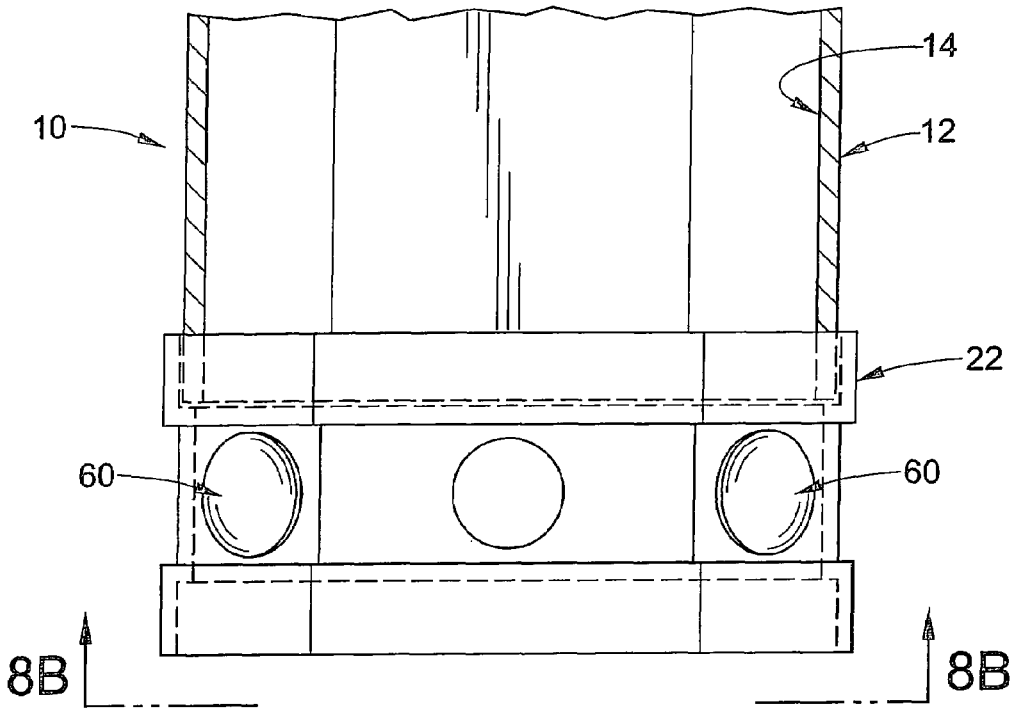
FIG. 8A illustrates the cup dispenser housing of FIG. 1 with the cup retainers illustrated in FIGS. 6A–6C connected thereto in a second operative arrangement.
Figure 8B:
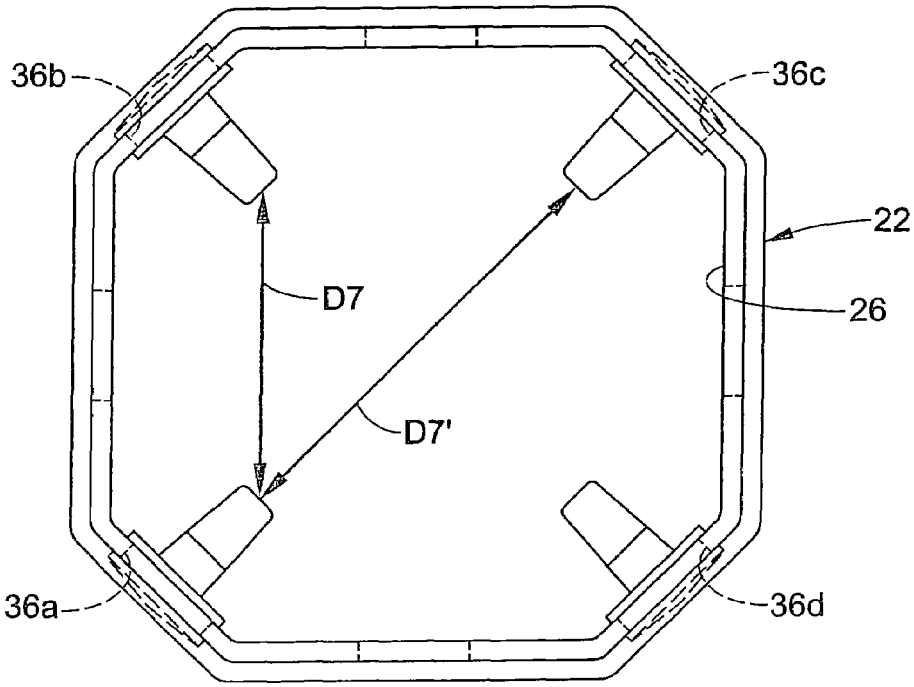
FIG. 8B is a view taken along line 8B—8B of FIG. 8A.

With reference now to FIGS. 7A and 7B, a plurality of the cup retainer studs 60 are operatively secured in the apertures 34*a*–34*d*, respectively, to define a first operative position for the cup retainer studs 60. In this position, a distance D6 is defined between successive or consecutive cup-retention fingers 66 (measured from tip-to-tip or otherwise) and, if arranged in opposed pairs as illustrated, a distance D6' is defined between opposed cup-retention fingers 66. In FIGS. 8A and 8B, the plurality of the cup retainer studs 60 are operatively secured in the apertures 36*a*–36*d*, respectively, to define a second operative position for the cup retainer studs 60. In this position, a distance D7 is defined between successive or consecutive cup-retention fingers 66 (measured from tip-to-tip or otherwise) and, if arranged in opposed pairs as illustrated, a distance D7' is defined between opposed cup-retention fingers 66.

Regardless of the measuring method used, the distance D6,D6' defined between the fingers 66 when the cup retainer studs 60 are located in their first operative positions is less than a corresponding distance D7, D7' defined between the fingers 66 when the cup retainer studs 60 are located in their second operative positions. Those of ordinary skill in the art will recognize that the cup dispenser is adapted to dispense a first cup size or range of cup sizes when the cup retainer studs 60 are located in their first operative positions (FIGS. 7A,7B), and the cup dispenser is adapted to dispense a second, larger cup size or range of cup sizes when the cup retainer studs 60 are located in their second operative positions (FIG. 8A,8B). in this embodiment, some of the cup retainer studs 60 can be placed in the first operative position while others are placed in the second operative position to adjustably accommodate different sizes and shapes of cup-shaped articles being dispensed.

As described above in relation to the fingers 44 of the cup retainer 40, the fingers 66 can also optionally be conformed to flex more easily in a first direction than in a second direction. In one such alternative embodiment, the fingers 66 are designed to flex more easily moving inwardly toward the cup storage space 14 so that a stack of nested cups can be more easily inserted into the cup storage space 14 to reload the cup dispenser. This can be accomplished in a wide variety of ways. In one embodiment as shown in FIG. 7B, a slit or groove G66 is defined in an outer or bottom surface at least some or all of the fingers 66 (only one groove G66 is shown) The groove G66 extends partially through a thickness of the finger 66 so as to define a weakened or thin hinge region in each finger 66 that facilitates flexing of the finger 66 in one direction at the location of the groove G66. The groove G66 can be defined as part of the molding process for the retainer studs 60 or can be defined or created in a separate process.

Figure 9:
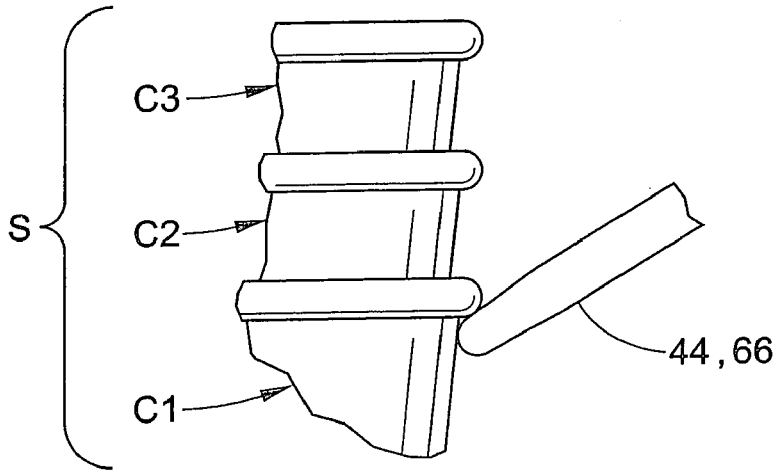
FIG. 9 is a partial section view of a cup retainer formed in accordance with the present invention as used to retain a stack of nested cups or other cup-shaped articles.

FIG. 9 illustrates a stack S comprising a plurality of nested cups C1C2,C3. The stack S is held in the cup-receiving space 14 of the cup storage portion 12 by the fingers 44,66 of the cup retainers 40,60, respectively. It can be seen that the outermost cup C1 can be pulled past the resilient finger 44,66 and the finger will then engage and prevent passage of the next cup C2.

The invention has been described with reference to preferred embodiments. Modifications and alterations will occur to those of ordinary skill in the art to which the invention pertains upon reading this specification. It is intended that the invention and claims be construed as including all such modifications and alterations.

Having thus described the preferred embodiments, what is claimed is:

1. A dispenser for cup-shaped articles comprising:

a housing defining a storage portion adapted to receive an associated stack of nested cup-shaped articles, said housing comprising an open end that communicates with the storage portion;

a cup retainer mounting base located adjacent said open end of said housing, said mounting base defining an opening that communicates with the open end of the housing, a first plurality of mounting openings, and a second plurality of mounting openings; and, a cup retainer connected to said mounting base and restricting said opening of said mounting base, said cup retainer movable between at least first and second operative positions wherein said cup retainer restricts said opening of said mounting base more in said first operative position as compared to said second operative position.

2. The dispenser as set forth in claim 1, wherein said cup retainer comprises a plurality of resilient cup-retention fingers that extend radially inwardly from said mounting base.

3. The dispenser as set forth in claim 2, wherein said plurality of fingers are all connected to an annular band that circumscribes said mounting base.

4. The dispenser as set forth in claim 3, wherein said band is resiliently radially expandable.

5. The dispenser as set forth in claim 3, wherein said band and said fingers are defined as a one-piece molded construction.

6. The dispenser as set forth in claim 1, wherein said plurality of fingers project respectively through said first plurality of mounting openings when said cup retainer is located in said first operative position and said plurality of fingers project respectively through said second plurality of mounting openings when said cup retainer is located in said second operative position.

7. The dispenser as set forth in claim 6, wherein first and second said plurality of mounting openings comprise apertures defined through said mounting base.

8. The dispenser as set forth in claim 2, wherein a first tip-to-tip distance is defined between successive fingers when said cup retainer is located in said first operative position and a second tip-to-tip distance is defined between successive fingers when said cup retainer is located in said second operative position, and wherein said second tip-to-tip distance is greater than said first tip-to-tip distance.

9. The dispenser as set forth in claim 2, wherein at least one of said fingers comprises a groove defined therein, said at least one finger flexing at said groove more easily in a first direction as compared to a second direction.

10. The dispenser as set forth in claim 2, wherein each of said plurality of cup retention fingers is defined as part of a stud member, each of said stud members being separate from the other stud members.

11. The dispenser as set forth in claim 9, wherein each of said plurality of stud members comprises a base, and wherein each of said stud members is selectively fixedly secured to said cup retainer mounting base by engagement of said stud member base with said cup retainer mounting base.

12. The dispenser as set forth in claim 10, wherein each of said plurality of stud members comprises a base, and wherein each of said stud members is selectively fixedly secured to said cup retainer mounting base by engagement of said stud member base with said cup retainer mounting base.

13. A retainer for cup-shaped articles, said retainer comprising:

a resilient annular member; and, a plurality of fingers connected to and projecting radially inwardly from said annular member, said fingers defining therebetween a space for passage of cup-shaped articles, said annular member selectively radially expandable to increase a distance between said fingers to accommodate larger sized cup-shaped articles in said space, wherein said fingers are resiliently flexible in first and second directions.

14. The retainer as set forth in claim 13, wherein said annular member and said plurality of fingers are defined together as a one-piece construction.

15. A dispenser for cup-shaped articles, said dispenser comprising:

a body comprising an open end;

a plurality of resilient fingers connected to said body adjacent said open end, wherein at least some of said fingers are selectively movable between different operative positions to adjust spacing between said fingers when said fingers are in an unflexed state, wherein said fingers flex in a first direction during dispensing operations and flex in a second direction during loading operations, and wherein said fingers are interconnected by a resilient annular band.

16. The dispenser as set forth in claim 15, wherein said fingers and said annular band are defined as a one-piece construction.

17. The dispenser as set forth in claim 15, wherein said fingers are conformed to flex more easily in said second direction as compared to said first direction.

* * * * *